US006290369B1

(12) United States Patent
Lin

(10) Patent No.: US 6,290,369 B1
(45) **Date of Patent: *Sep. 18, 2001**

(54) ILLUMINATION DEVICE FOR CONTAINERS WITH PIPE FLANGED ACCESS PORTS

(76) Inventor: Peter Lin, 345 Ivyland Rd., Warminster, PA (US) 18974

( * ) Notice: Subject to any disclaimer, the term of this patent is extended or adjusted under 35 U.S.C. 154(b) by 0 days.

This patent is subject to a terminal disclaimer.

(21) Appl. No.: 09/503,465

(22) Filed: Feb. 14, 2000

Related U.S. Application Data

(63) Continuation-in-part of application No. 09/135,523, filed on Aug. 17, 1998, now Pat. No. 6,106,136.

(51) Int. Cl.[7] ..... F21Q 1/00

(52) U.S. Cl. ..... 362/191; 362/101; 362/190; 362/455; 362/397; 362/96; 362/154; 362/311; 362/374; 285/24; 217/98

(58) Field of Search ..... 362/101, 190, 362/191, 455, 397, 96, 154, 311, 374; 285/24; 217/98

(56) References Cited

U.S. PATENT DOCUMENTS 3,962,675 * 6/1976 Rowley et al. ..... 240/26
4,052,608 * 10/1977 Papenmeier ..... 362/368
4,763,231 * 8/1988 Houplain ..... 362/148
5,207,499 * 5/1993 Vajda et al. ..... 362/96
5,230,556 * 7/1993 Canty et al. ..... 362/32
6,106,136 * 8/2000 Lin ..... 362/191

* cited by examiner

*Primary Examiner*—Stephen Husar
*Assistant Examiner*—Anabel Ton
(74) *Attorney, Agent, or Firm*—LaMorte & Associates

(57) ABSTRACT

An illumination device for vessels that have access ports terminated with pipe flanges. The illumination device includes a retention collar that is adapted to receive a flashlight at its first end. The opposite second end of the retention collar terminates with a flange. A conduit extends through the retention collar from the first end to the second end. A mounting element is provided for attaching the retention collar and the flashlight to the access port of the vessel. The mounting element includes an annular base plate. A coupling mechanism is attached to the annular base plate. The coupling mechanism selectively receives the flange of the retention collar. The annular base plate of the mounting bracket clamps to the pipe flange of the vessel over an inspection window. This provides an unobstructed passage through which light from the flashlight can enter the access port of the vessel.

19 Claims, 5 Drawing Sheets

ILLUMINATION DEVICE FOR CONTAINERS WITH PIPE FLANGED ACCESS PORTS

RELATED APPLICATIONS

This Application is a Continuation-In-Part of U.S. patent application Ser. No. 09/135,523 filed Aug. 17, 1998, now U.S. Pat. No. 6,106,136, entitled Illumination Device For Containers With Pipe Flanged Access Ports.

BACKGROUND OF THE INVENTION

1. Field of the Invention

In general, the present invention relates to illumination devices for illuminating opaque containers through bung hole orifices or similar access ports. More particularly, the present invention relates to illumination devices for containers that have access ports that terminate with pipe flanges.

2. Description of the Prior Art

In the manufacture and processing of pharmaceutical products, medical cultures, dairy products, and other materials that require a sanitary processing environment, it is common for materials to be stored and transported in sealed containers and other vessels. Such containers and vessels are commonly manufactured of stainless steel or some other material that can be readily cleaned and sterilized for reuse. A wide variety of such containers are manufactured by Eagle Stainless Container of Warminster, Pa.

A common feature of such stainless steel containers and vessels is the use of connector ports that terminate with a pipe flange. A pipe flange is a general term used to describe a circular flange that radially extends from the neck of the container or some other access port. The use of such connector ports on the containers makes it easier to connect the container to piping and other containers in a sterile fashion. To join any two flanged connections together, the two flanged connectors are placed in abutment so that the openings in the center of each of the flanges align. An O-ring or other sealer is placed between the two abutting flanges. The flanged connections are then clamped together with some type of pipe flange clamp. Examples of such clamps can be found in U.S. Pat. No. 5,018,768 to Palatchy, entitled Pipe Coupling Hinge, and U.S. Pat. No. 4,568,115 to Zimmerly, entitled Multi-Piece Pipe Clamp.

Many containers and vessels used in the pharmaceutical industry contain more that one access port, wherein each port terminates with a flanged connection. In many applications, vessels with multiple access ports are used when it is desirous to view the contents of the vessel. In such an application, at least one of the access ports is capped with an inspection glass. By looking through the inspection glass, a person can see the contents of the vessel. A problem associated with the use of inspection glasses is that the contents of the vessel are often dark. Consequently, in order to view the contents of the container, the interior of the container must be artificially illuminated.

If a vessel only has a single access port, the contents of the vessel must be illuminated and viewed through that same port. U.S. Pat. No. 4,052,608 to Papenmeier, entitled Inspection Glass Light and U.S. Pat. No. 5,230,556 to Canty, entitled Lighting And Viewing Light, both show devices used for such an application. Such devices are commonly very expensive and are highly labor intensive to install and remove from vessels. It is not uncommon for such illumination devices to be bolted directly onto an access port of a vessel with numerous bolts. This makes the illumination device very difficult to remove when the vessel is to be cleaned and sterilized.

A simpler and less expensive approach to illuminating the contents of a vessel, involves the use of a vessel with at least two access ports. By using such a vessel, the contents of the vessel can be illuminated through one of the access ports, while the contents of the vessel are viewed through a second access port. In the prior art, the contents of the vessel are commonly illuminated with a portable flashlight that is shown into the vessel through an access port. The flashlight is commonly held in one hand at one access port as the person peers through the other access port. Since a person is using one hand to hold the flashlight in place, it is often difficult for a person to view the contents of a vessel and perform some other activity at the same time. For example, if a person is transferring material into a container, it would be difficult for that person to operate the transfer controls and hold the flashlight while simultaneously looking into the vessel.

Another problem with the use of flashlights is that it requires person to carry a working flashlight with them at all times when they wish to view the contents of a vessel. The face of the flashlight must also be held flush against the inspection glass in order for the light from the flashlight to properly pass through the inspection glass and illuminate the contents of the container.

A need therefore exists in the art for a low cost illumination device that can be connected to a vessel containing access ports with flanged connectors. Such an illumination device would eliminate the need of a person to hold and manipulate a flashlight when viewing the contents of a sealed vessel. This need is met by the present invention as described and claimed below.

SUMMARY OF THE INVENTION

The present invention is an illumination device for vessels that have access ports terminated with pipe flanges. The illumination device includes a retention collar that is adapted to receive a flashlight at its first end. The opposite second end of the retention collar terminates with a flange. A conduit extends through the retention collar from the first end to the second end. A mounting element is provided for attaching the retention collar and the flashlight to the access port of the vessel. The mounting element includes an annular base plate. A coupling mechanism is attached to the annular base plate. The coupling mechanism selectively receives the flange of the retention collar in an orientation wherein the retention collar is supported over at least a portion of the area defined by the mounting bracket. The annular base plate of the mounting bracket clamps to the pipe flange of the vessel over an inspection window. This provides an unobstructed passage through which light from the flashlight can enter the access port of the vessel.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention illumination device can be used to illuminate many different types of vessels, containers and pipes, the present invention is particularly well suited for illuminating stainless steel pharmaceutical containers. Accordingly, by way of example, the present invention illumination device will be described in the application of illuminating a stainless steel pharmaceutical container with multiple access ports.

Figure 1:
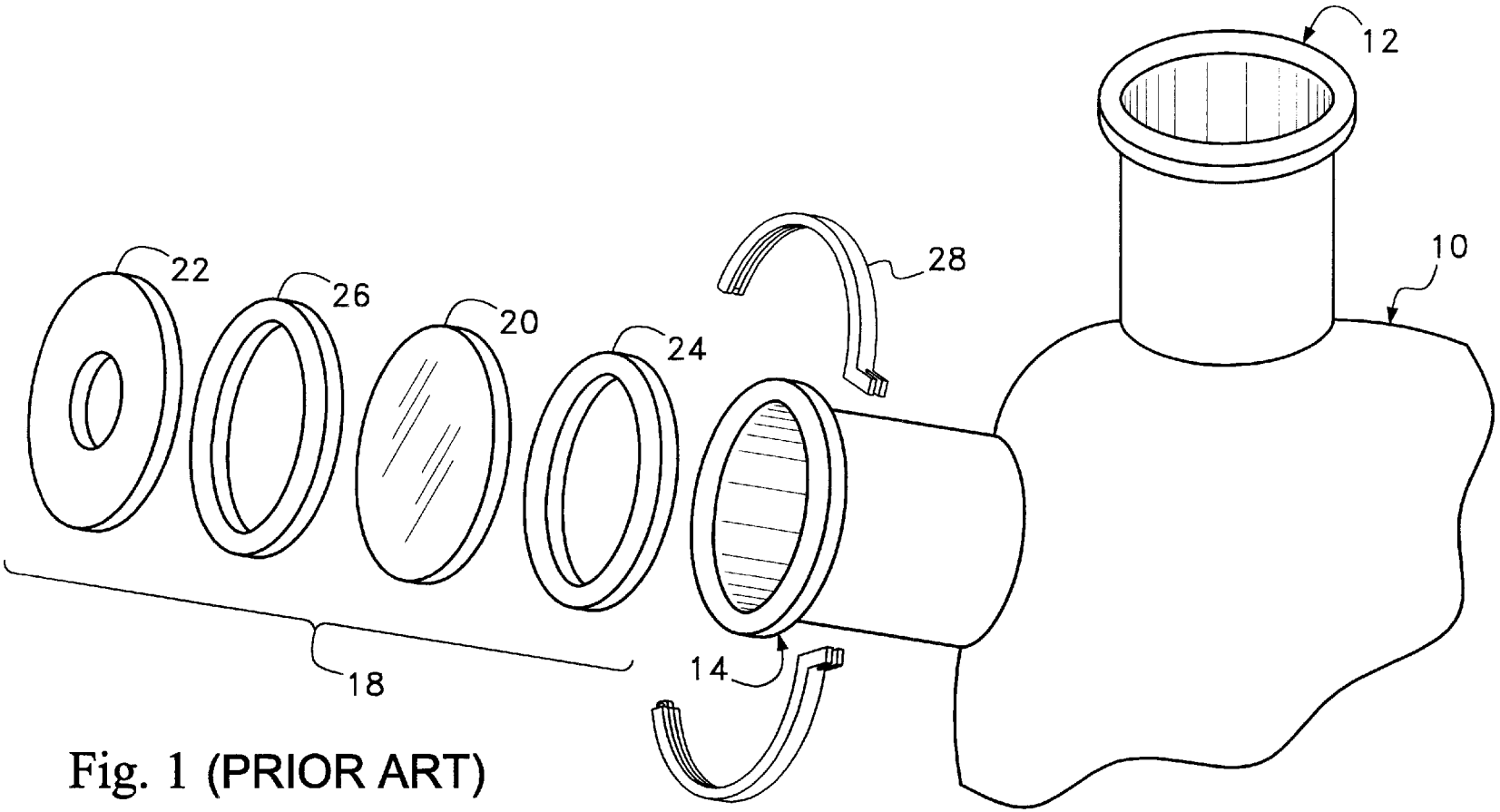
Fig. 1 (PRIOR ART)
FIG. 1 is an exploded, perspective view of a prior art vessel and inspection glass assembly.

Referring to FIG. 1, there is shown a typical prior art container 10 with multiple access ports. The multiple access ports include the main access port 12 and at least one other auxiliary access port 14. Each of the access ports terminates with a pipe flange configuration. The main access port commonly is used to fill the container 10. After the container 10 is filled, the main access port 12 is typically sealed. In the shown embodiment, the auxiliary access port 14 is sealed with an inspection glass assembly 18. An inspection glass assembly 18 is essentially a transparent cap assembly for an access port that enables a person to see into the access port without exposure to the contents of the container. Inspection glass assemblies typically include a glass window 20 and an annular cap 22. The glass window 20 seals against the flanged access port 14 of the container with a first gasket 24. The annular cap 22 seals against the glass window 20 with a second gasket 26. The annular cap 22 is clamped to the flange of the access port 14 with a traditional pipe flange clamp 28.

Figure 2:
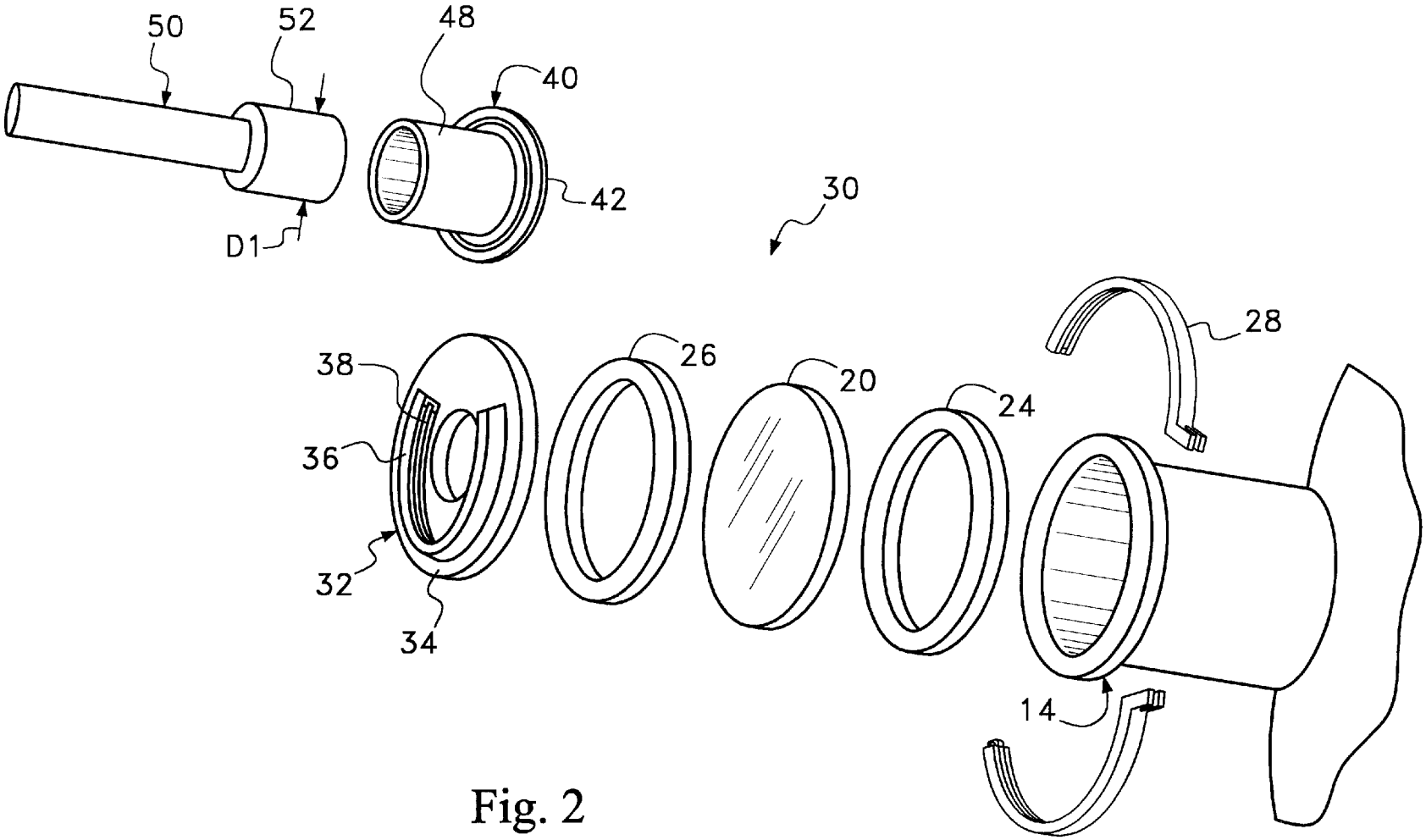
FIG. 2 is an exploded, perspective view of an illumination device in accordance with the present invention.

Referring to FIG. 2, an illumination device 30 is shown in accordance with the present invention. The illumination device 30 includes a mounting element 32 that replaces the prior art annular cap 22 (FIG. 1) of a traditional inspection glass assembly 18 (FIG. 1). The mounting element 32 contains a clamping base 34 that is configured have the same dimensions as the prior art annular cap 22 (FIG. 1). The clamping base 34 is annular in configuration and is sized to engage the second gasket 26 and seal it against the glass window 20 without obstructing the glass window 20. The thickness of the clamping base 32 is sized to be generally the same as the prior art annular cap 22 (FIG. 1). In this manner, a traditional pipe flange clamp 28 can be used to bias the clamping base 34 against the second gasket 26 and seal the glass window 20 over the access port 14.

Figure 3:
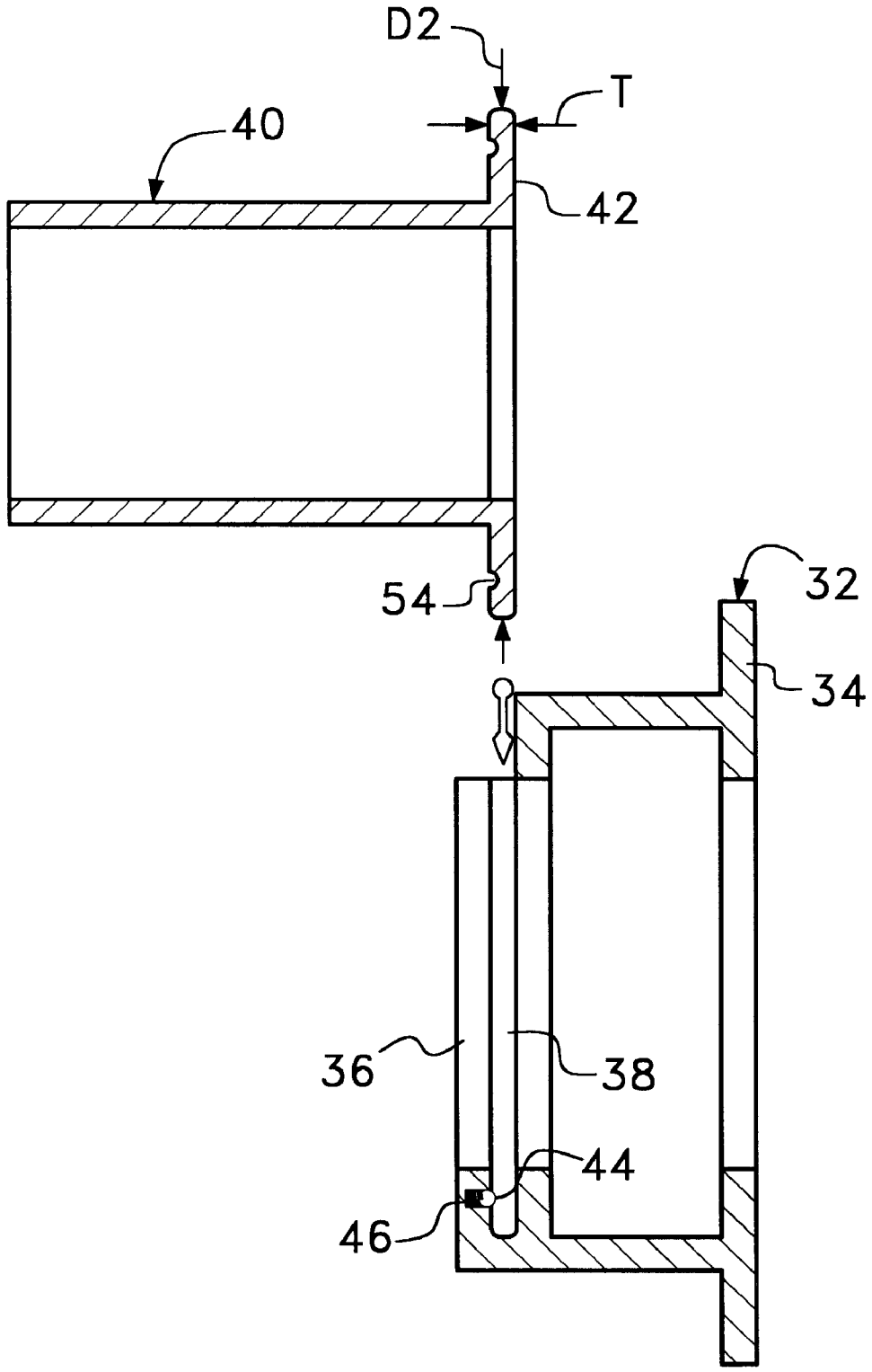
FIG. 3 is a cross sectional view of a segment of the embodiment of FIG. 2, viewed along section line 3—3.

A generally U-shaped structure 36 is supported above the top surface of the clamping base 34. The U-shaped structure 36 defines a slot 38 having an open mouth. The slot 38 is sized to receive a flanged base 42 of the flashlight retention collar 40, as will later be described. Referring to FIG. 3, it can be seen that a locking ball 44 extends into the slot 38 between the U-shaped structure 36 and the below lying clamping base 34. The locking ball 44 is a small ball bearing that is biased partially into the slot 38 by a spring 46. However, the spring 46 enables the locking ball 44 bearing to fully retract out of the slot 38, if the locking ball 44 is pushed upwardly with a force sufficient to overcome the bias of the spring 46.

Returning to FIG. 2, it can be seen that a flashlight 50 is provided. Although most any prior art flashlight 50 can be adapted for use with the present invention, a preferred flashlight would have a head 52 with a circular cross-section. The head 52 of the flashlight 50 has a predetermined diameter D1. The head 52 of the flashlight 50 is mounted to a retention collar 40. The retention collar 40 contains a cylindrical segment 48, wherein the interior of the cylindrical segment 48 is sized to receive head 52 of the flashlight 50. To join the flashlight 50 to the retention collar 50, the cylindrical segment 48 of the retention collar 50 is sized to receive the head 52 of the flashlight 50 with an interference fit. However, other types of interconnection mechanisms can also be used. For example, both the head of the flashlight and the cylindrical segment of the retention collar can be similarly threaded or some type of twist lock mechanism can be employed.

An annular flange 42 is disposed at the distal end of the retention collar 40. The open center of the cylindrical segment 48 of the retention collar 40 aligns with the aperture in the center of the annular flange 40, thereby creating a continuous opening that passes directly through the retention collar 40. The continuous opening aligns with the beam of the flashlight 50. Accordingly, the beam of light produced by the flashlight 50 will travel through the retention collar 40 essentially unobstructed.

Figure 4:
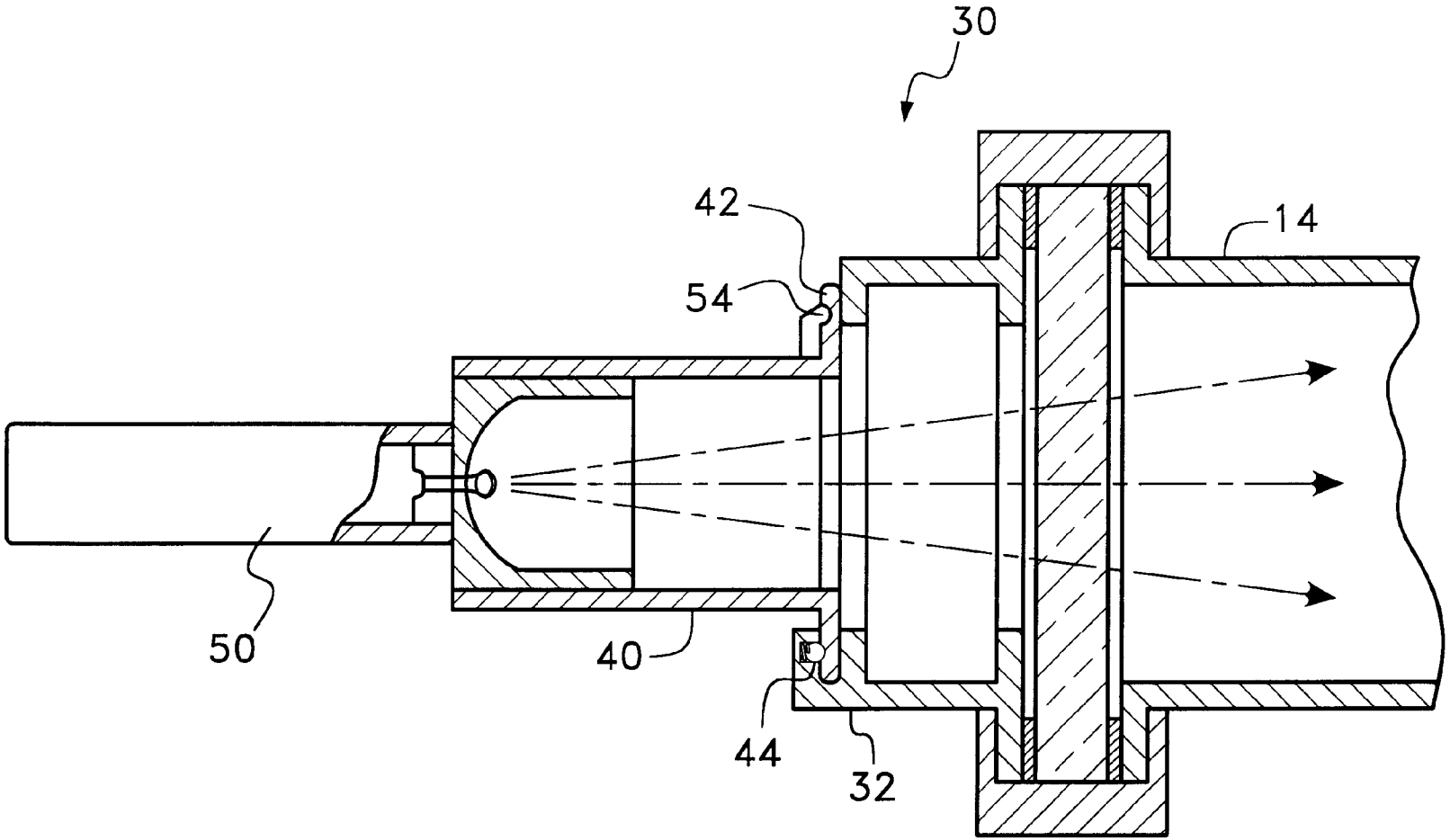
FIG. 4 is an assembled cross sectional view of the embodiment of FIG. 1.

Referring to FIG. 3 in conjunction with FIG. 4, it can be seen that the annular flange 42 at the distal end of the retention collar 40 has a diameter D2 and a thickness T. Both of these dimensions are sized to be received into the slot 38 that exists between the clamping base 34 of the mounting element 32 and the generally U-shaped structure 36 positioned above the clamping base 34. The annular flange 42 of the retention collar 40 is received into the slot 38 by sliding the annular flange between the clamping base 32 and the generally U-shaped structure 36 from the direction of the open end of the generally U-shaped structure 36.

A groove 54 is formed on the surface of the annular flange 42 that faces the flashlight. The groove 54 follows the periphery of the annular flange 42. When the annular flange 42 of the retention collar 40 is slid into the slot 38 of the mounting element 32, the locking ball 44 engages the groove 54. The presence of the locking ball 44 in the groove 54 of the annular flange 42 causes the retention collar 40 and the mounting element 32 to be mechanically interconnected. The locking ball 44 therefore prevents the annular flange 42 from inadvertently departing from the slot 38, should the illumination device be inverted or otherwise oddly manipulated. However, since the locking ball 44 is spring loaded, the annular flange 424 can be manually removed from the slot 38 by the application of a force sufficient enough to cause the locking ball 44 to retract out of the slot 38 and disengage the annular flange 42. Accordingly, the retention collar 40 can be manually removed from the mounting bracket 32 in a rapid fashion without the use of tools.

From FIG. 4, it can be seen that the illumination device 30 attaches to the access port 14 of a vessel without bolts or in any other manner that would require the use of tools. The illumination device 30 retains a flashlight 50 in the proper orientation over an access port 14. The flashlight 50 is self supporting and does not need to be held. The illumination device 50 can be rapidly attached or removed from any vessel having an inspection glass. Since the illumination device 50, is inexpensive and can be mounted directly to the vessel, the illumination device can be shipped as part of the vessel. Consequently, inspectors need not carry their own flashlights when inspecting vessels.

When the vessel is to be sterilized, the flashlight 50 and retention collar 40 can be removed. The mounting element 32 can then be sterilized with the vessel.

In the embodiment shown in FIG. 2, FIG. 3 and FIG. 4, the illumination device is used to completely cover an access port. This is not a problem if two access ports are available. Once access port can be used to illuminate the contents of the vessel and the other access port can be used to view the contents of the vessel. However, in certain applications, only a single access port is provided. In such applications, the contents of a vessel must be illuminated and viewed through the same port.

Figure 5:
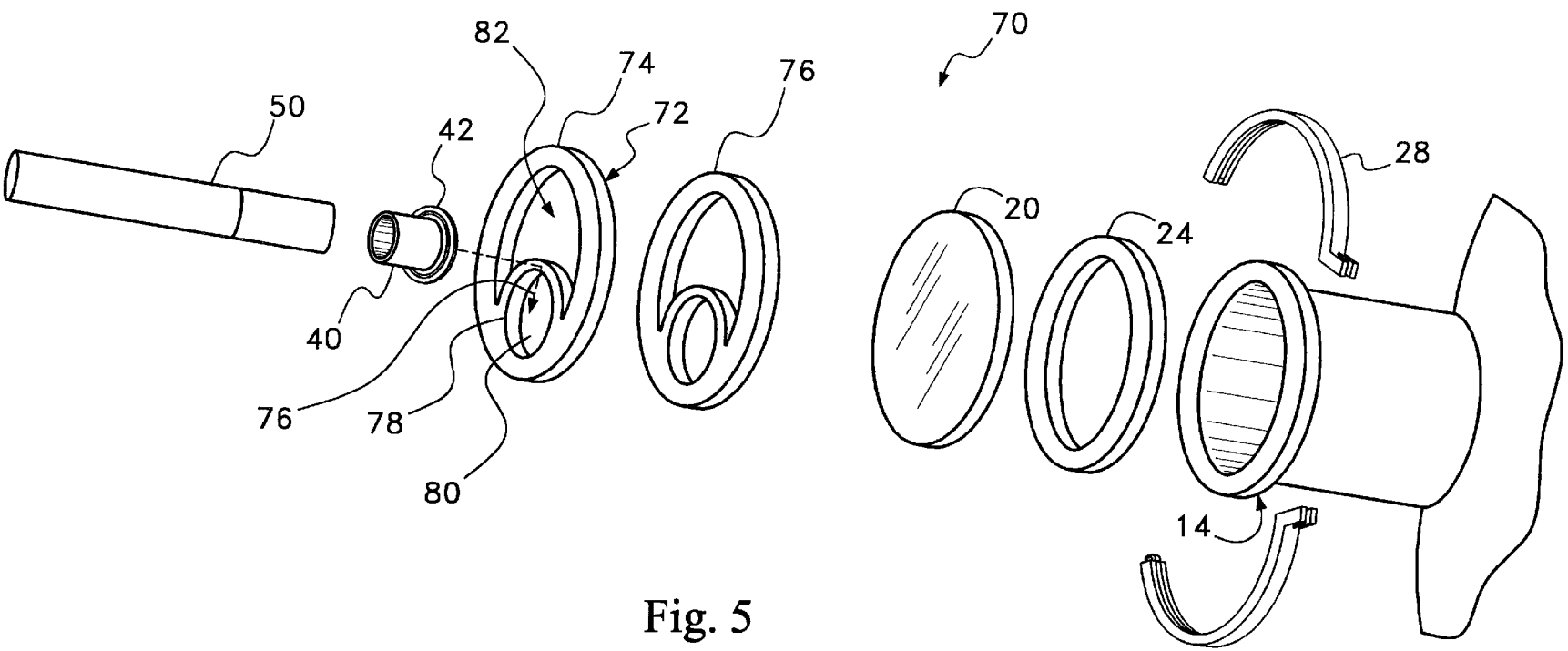
FIG. 5 is an exploded, perspective view of an alternate embodiment of an illumination device in accordance with the present invention.

Referring to FIG. 5, an embodiment of the present invention illumination device 70 is shown that is adapted for use on an vessel having only one available access port 14. The illumination device 70 contains a mounting element 72 that replaces the prior art annular cap 22 (FIG. 1) of a traditional inspection glass assembly 18 (FIG. 1). The mounting element 72 contains an annular clamping base 74 that is configured have the same dimensions as the prior art annular cap 22 (FIG. 1). The annular clamping base 74 seats against a gasket 76 and seals the gasket 76 against the glass window 20. The thickness of the clamping base 74 is sized to be generally the same as the prior art annular cap 22 (FIG. 1). In this manner, a traditional pipe flange clamp 28 can be used to bias the clamping base 74 against the gasket 76 and seal the glass window 20 over the access port 14.

A generally U-shaped structure 76 is disposed within the area defined by the annular clamping base 74. The U-shaped structure 76 has a diameter that is less than half of the diameter of the clamping base 74. The U-shaped structure 76 defines a slot 78 having an open mouth. The slot 78 is sized to receive a flanged base 42 of the flashlight retention collar 40, in the same manner as was previously described with earlier embodiments.

The U-shaped structure 76 defines a small circular window 80 through which light from the flashlight 50 can enter the access port 14. However, since the U-shaped structure 76 has a diameter that is much smaller that the overall annular clamping base 74, a majority of the area within the annual clamping base 74 remains unobstructed.

A larger second window 82 is defined by the annular clamping base 74. The second larger window 82 enables a person to see directly into the vessel, through the glass window 20, while the flashlight 50 illuminates the interior of the vessel through the first smaller window 80.

The gasket 76 that is interposed between the annular clamping base 74 and the glass window 20 is shaped to have the same circle-within-circle configuration as does the clamping base 74.

It will be understood that the various figures described above illustrate only one preferred embodiment of the present invention. A person skilled in the art can therefore make numerous alterations and modifications to the shown embodiment utilizing functionally equivalent components to those shown and described. For example, there are numerous configurations that can be substituted for the round annular flange and U-shaped slot illustrated. Numerous different configurations of flashlights and retention collars can also be used. All such modifications are intended to be included within the scope of the present invention as defined by the appended claims.

What is claimed is:

1. A illumination device, comprising:

a retention collar having a first end, adapted to receive a flashlight, and a second end that terminates with a flange, wherein a conduit extends through said retention collar from said first end to said second end;

a mounting element having an annular base plate that defines a first aperture, and a coupling mechanism for selectively receiving said flange of said retention collar in an orientation wherein said conduit of said retention collar aligns with said first aperture.

2. The device according to claim 1, wherein said annular base plate defines a second aperture that is not covered by said retention collar.

3. The device according to claim 1, further including a flashlight coupled to said first end of said retention collar, wherein said flashlight shines light through said first aperture.

4. The device according to claim 2, wherein said annular base plate of said mounting element is configured as a pipe flange.

5. The device according to claim 2, wherein said first end of said retention collar is sized to receive a flashlight with an interference fit.

6. The device according to claim 2, wherein said first end of said retention collar contains a connection mechanism for engaging a flashlight.

7. The device according to claim 1, wherein said coupling mechanism is a slot sized to receive said flange of said retention collar.

8. The device according to claim 6, wherein a generally U-shaped structure is affixed to said annular base plate, wherein said slot is disposed between said generally U-shaped structure and said annular base plate.

9. The device according to claim 7, further including a locking mechanism for locking said flange of said retention collar into said slot.

10. The device according to claim 9, whereon said flange has a groove disposed therein.

11. The device according to claim 10, wherein said locking mechanism includes a locking element connected to said mounting element that engages said groove when said flange of said retention collar is in said slot.

12. The device according to claim 11, wherein said locking element is a spring biased ball.

13. The device according to claim 2, further including a glass window, wherein said glass window covers said first aperture and said second aperture of said annular base plate.

14. A method of attaching an illumination device to the access port of a vessel, wherein the access port terminates with a pipe flange, said method comprising the steps of:

providing a first gasket and a second gasket;

providing a glass window providing a mounting element having an annular base plate;

clamping said first gasket, said glass window and said second gasket between said annular base plate and said the pipe flange, thereby creating a seal over the access port; and connecting a light source to said mounting element, wherein said light source is oriented to direct a beam of light through at least a portion of said annular base plate and said glass window into said access port.

15. The method according to claim 14, wherein said step of connecting a light source to said mounting element includes the substeps of:

providing a flashlight;

connecting the flashlight to a retention collar;

coupling said retention collar to said mounting element.

16. The method according to claim 15, wherein said retention collar has a first end, adapted to receive a flashlight, and a second end that terminates with a flange, wherein a conduit extends through said retention collar from said first end to said second end.

17. The method according to claim 16, wherein said mounting element further includes a coupling mechanism for selectively receiving said flange of said retention collar in an orientation wherein said conduit of said retention collar aligns with said central aperture of said annular base plate.

18. The method according to claim 17, wherein said flashlight is joined to said retention collar with an interference fit.

19. The method according to claim 16, wherein a slot is disposed on said mounting element and retention collar is joined to said mounting element by passing said flange of said retention collar into said slot.

* * * * *